United States Patent [19]

Leivenzon et al.

[11] Patent Number: 4,533,905

[45] Date of Patent: Aug. 6, 1985

[54] INDICATING MEANS FOR A DOOR OPERATOR DEVICE

[75] Inventors: Simon Leivenzon; Steven Leivenzon, both of Caulfield, Australia

[73] Assignee: Firmagroup Australia Pty. Ltd., Cheltenham, Australia

[21] Appl. No.: 456,078

[22] PCT Filed: May 14, 1982

[86] PCT No.: PCT/AU82/00077

§ 371 Date: Dec. 15, 1982

§ 102(e) Date: Dec. 15, 1982

[87] PCT Pub. No.: WO82/04094

PCT Pub. Date: Nov. 25, 1982

[51] Int. Cl.[3] ..... G08B 21/00

[52] U.S. Cl. ..... 340/524; 340/686; 49/14

[58] Field of Search ..... 340/686, 521, 524, 960; 49/14, 199

[56] References Cited

U.S. PATENT DOCUMENTS 2,316,682 4/1943 Finnegan ..... 340/960

3,161,852 12/1964 Timm ..... 340/960

*Primary Examiner*—Anthony V. Ciarlante

*Attorney, Agent, or Firm*—Pollock, Vande Sande & Priddy

[57] ABSTRACT

Door operator device comprising an indicator that the door is in either fully opened or fully closed condition, including a drive for moving the door to these positions in response to operation of an initiator connected therewith. The device includes a switch circuit to switch off the drive when the door has reached either of the positions, and the indicator is operatively interconnectable with the door operator device to provide the information that the door is in its fully opened or closed condition.

14 Claims, 8 Drawing Figures

| | | | |
|---|---|---|---|
| IC1 ~ M7650 | | T1 ~ | BC 377 |
| IC2 ~ M7701 | | T2 | -- |
| IC3 ~ HEF 4093BP | | T3 | -- |
| IC4 ~ SCL4040BE | | T4 | BC377 |
| RLUP ~ RELAY 'UP' | | T5 | --- |
| RLDN ~ RELAY 'DOWN' | | T6 | BC377 |
| RLLL ~ RELAY 'LIGHT' | | T7 | — |
| | | T8 | -- |
| D1 ~ IN4001 | | T9 | BC377 |
| D2 /D11 ~ IN914 | | T10 | -- |
| | | T11 | -- |

INDICATING MEANS FOR A DOOR OPERATOR DEVICE

FIELD OF THE INVENTION

This invention relates to an indicating means for a door operator device for indicating the fully open and/or fully closed position and/or for indicating movement of the door between those opened or closed positions. The door must be a roller shutter door or a tilt door or a sliding door or other door or gate.

BACKGROUND OF THE INVENTION

Hitherto in the art of automatic operator devices for garage doors it has been common to provide a push button means at a remote location such as in the kitchen of a house or in an office adjacent a factory, whereby the garage door can be operated simply by depressing the button. It is a problem to know if the door is fully opened and/or fully closed as it is often not possible to physically view the door from the remote location.

The problem is even more acute now, as in recent times there has been provided a circuit means within the electric driving means which opens and/or closes the door, to reverse the movement of the door during closing if the door should strike an object. This feature is provided to prevent (A) damage to objects which may be under the door and (B) to prevent damage to the door. Thus, in the prior art constructions, when the switch is operated at the remote location, and the door moved from the opened position to the closed position, if it engages with an object under the door it then moves to the fully opened position again. The operator is then not aware that the door is open unless it is physically inspected.

SUMMARY OF THE INVENTION

Accordingly, the present invention has been devised to provide a means to indicate when the door is fully opened and/or fully closed. A particularly preferred embodiment incorporates a feature which indicates that the door is moving towards the closed position and/or the opened position and then provides a further indication when the door has reached the respective fully opened and/or fully closed position.

Therefore in accordance with the present invention there may be provided an indicating means for a door operator device, said indicating means being for indicating either or both of a door fully opened and/or fully closed condition, said door operator device having drive means for moving the door to said positions in response to operation of initiating means, said operator device having circuit switch means to switch off the drive when the door has reached either of said positions, and wherein said indicating means is operatively interconnectable with said door operator device arranged to provide said indication when the door is in the respective fully opened or closed condition.

It is particularly preferred that said indicating means be operatively connected with said circuit switch means to provide an indication that the door has reached either of said positions in response to said electric circuit switch means operating to switch off the drive.

Most preferably, the indicating means is provided at a remote location and takes the form of an indicating lamp means for each of the respective opened and/or closed positions. It is particularly preferred that the lamp means be hard wired with respect to the electric circuit switch means, but it is feasible to use a radio control link between the electric circuit switch means and the indicating means and this is to be considered within the scope of the invention.

It is also particularly preferred to provide the indicating means in the form of one or more flashing L.E.D. lamps to indicate that the door is moving between the open and/or closed or the closed and/or opened positions. Most preferably this form of indicating means comprises flashing the open and/or closed lamp means until the door has reached the fully opened and/or closed position, whereupon the lamp means remains illuminated continuously.

BRIEF DESCRIPTION OF THE DRAWINGS

In order that the invention may be more clearly understood, reference will now be made to the accompanying drawings, wherein several embodiments of the invention are shown for purposes of illustration, and wherein.

DESCRIPTION OF PREFERRED EMBODIMENTS

Figure 1:
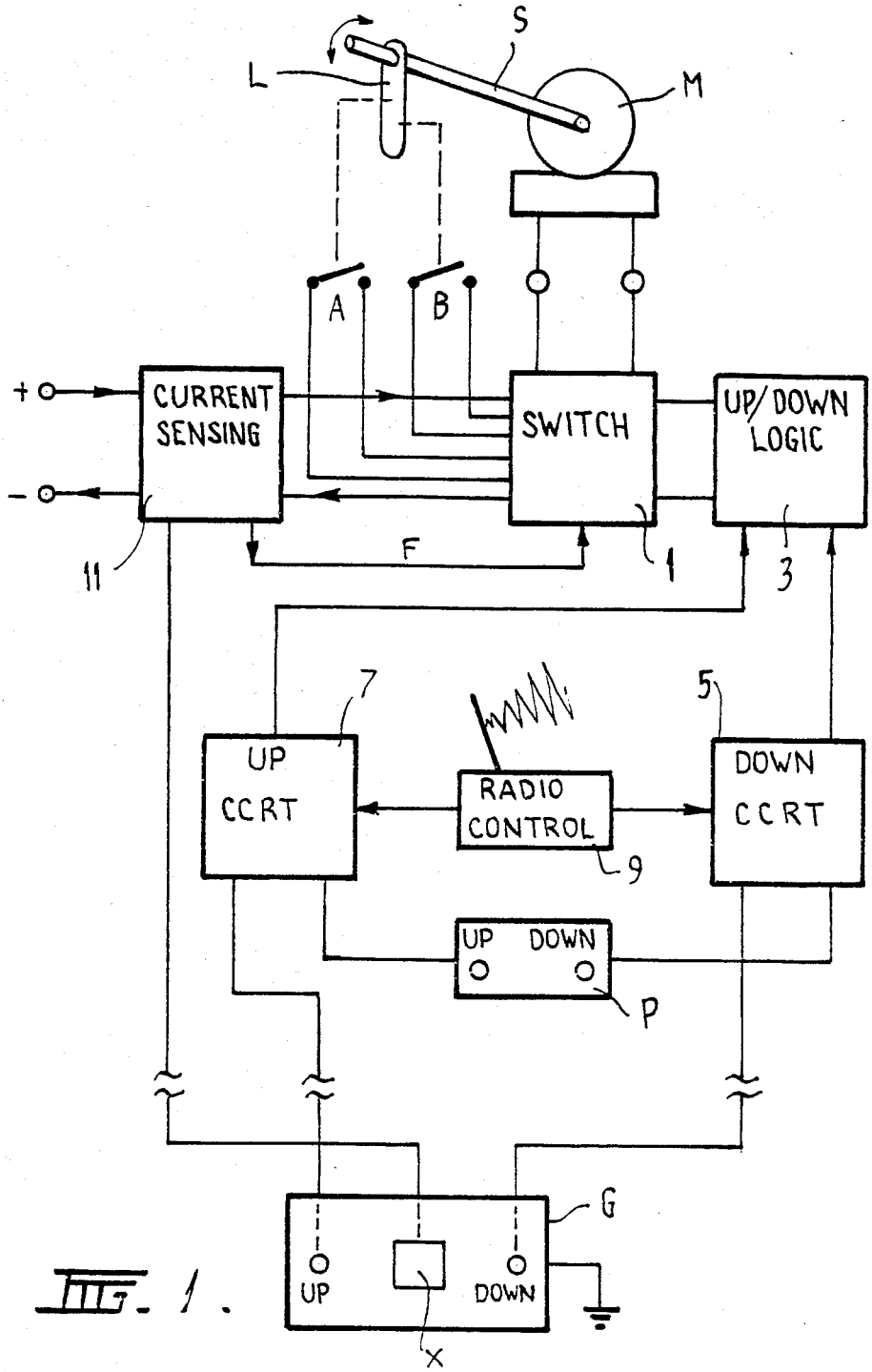
FIG. 1 is a block schematic diagram of one embodiment of the invention and FIGS. 2A, 2B 3 and 4 are schematic diagrams of a further embodiment of the invention.

Referring first to the embodiment shown in FIG. 1, the motor shown generally by the numeral M is a conventional motor which is used to drive the door to the opened and/or closed position. The motor has a shaft shown generally by the numeral S with linkage means L thereon. The linkage means L and the shaft S usually comprise a gear train which winds screw threaded members and/or gear wheels to open and/or close the door. The motor M may have to rotate many times before the door is moved from the opened position to the closed position and vice-versa. The gear train shown generally by the linkage L and the shaft S must be regarded as diagramatic only. The motor M is controlled by an operator circuit comprising a SWITCH 1 which is used for switching on and off power to the motor M. The polarity of the voltage supplied to the motor M is determined by an UP/DOWN LOGIC CIRCUIT 3. Thus the motor M—a DC motor—can be made to rotate in either direction on appropriate operation of the UP/DOWN LOGIC CIRCUIT 3 and on activation of the SWITCH. The UP DOWN LOGIC CIRCUIT 3 is, in turn, controlled by a DOWN CIRCUIT 5 and an UP CIRCUIT 7. These respective circuits are, in turn, controlled by push buttons marked "UP", "DOWN" shown on an operator panel P. The operator panel P is usually placed at a convenient location adjacent the door. Alternatively the DOWN CIRCUIT and the UP CIRCUIT can be controlled from a radio control unit 9. The incoming power to the motor M passes through a CURRENT SENSING CIRCUIT 11 which senses if there is any increase in the current flowing to the motor M consequent on the door striking an object. If the door strikes an object, increased resistance to rotation of the motor M causes the motor M to draw extra current which, in turn, causes the CURRENT SENSING CIRCUIT 11 to generate a signal F which operates the SWITCH 1 to reverse the direction of drive of the motor M to drive the door in the opposite position. The drive chain, comprising the linkage L and the shaft S, operate to activate switches A and/or B placed respectively at either the fully opened and/or fully closed positions of the door. These switches are adjusted via linkages so that, when the gear train operates and has rotated a required distance, either switch A or B will close. This, in turn, causes activation of the SWITCH 1 to disconnect the supply to the motor M, thus holding the door in the fully opened and/or fully closed positions.

The general circuit and the mechanical construction described so far are substantially prior art. In particular, reference should be made to our Australian Patent Applications No. 59271/80 and 59407/80 which disclose one such circuit and one such mechanism. The disclosures in both of the specifications of those patent applications are incorporated by reference into the present specification.

The improvement over the prior art in this embodiment comprises the addition of an indicating means shown generally by reference G. The indicating means G is simply a panel having a push button switch X thereon and two indicating L.E.D.'s marked UP and DOWN respectively. The switch X is connected to both the DOWN CIRCUIT 5 and the UP CIRCUIT 7, such that on operation of the button X once, either the DOWN CIRCUIT 5 or the UP CIRCUIT 7 operates, and upon reactivation of the switch X then the opposite of the DOWN CIRCUIT 5 and/or UP CIRCUIT 7 is activated. This, in turn, causes the motor M to drive first in one direction and then, when the switch X is operated again, to drive in the opposite direction. As the motor M operates in response to activation of either the switch X or the switch P or the radio controlled unit, then the respective L.E.D. UP or DOWN on the control panel G are illuminated. As the motor M moves the door in either direction the operation of the CURRENT SENSING CIRCUIT 11 is sensed and this, in turn, is arranged to flash either the UP L.E.D. or the DOWN L.E.D in accordance with the direction of movement of the door. This, in turn, provides an indication at the remote location that the door is actually moving. When the door reaches either the fully opened and/or fully closed position and the respective switch A or B activated, the motor 1 is stopped by activation of the SWITCH 1. This, in turn, causes the CURRENT SENSING CIRCUIT 11 to sense that the motor is not operating and this causes the respective L.E.D.UP or DOWN to glow continuously, indicating that the door is in the fully opened and/or fully closed positions.

Figure 2A:
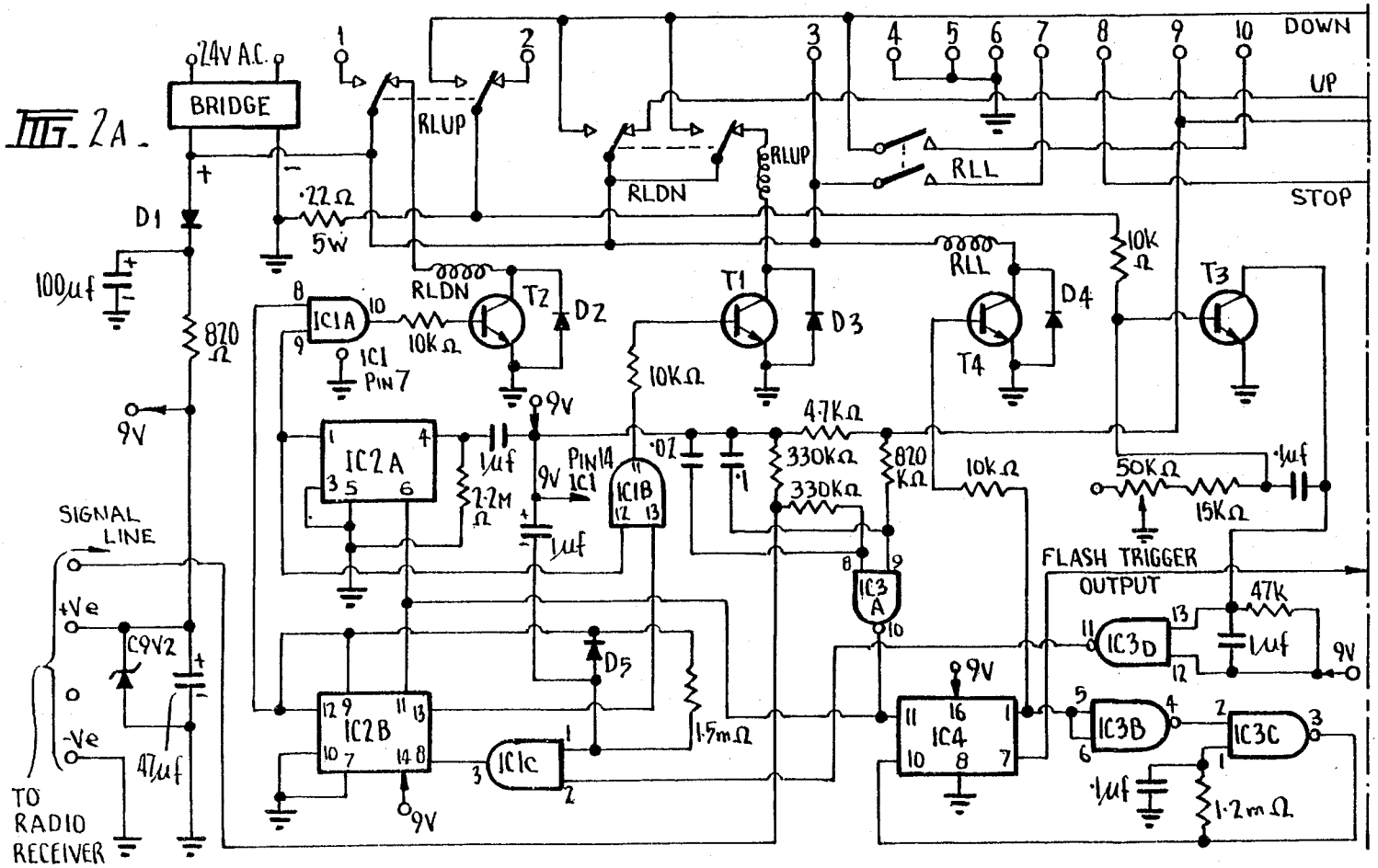
Figures 2B, 7:
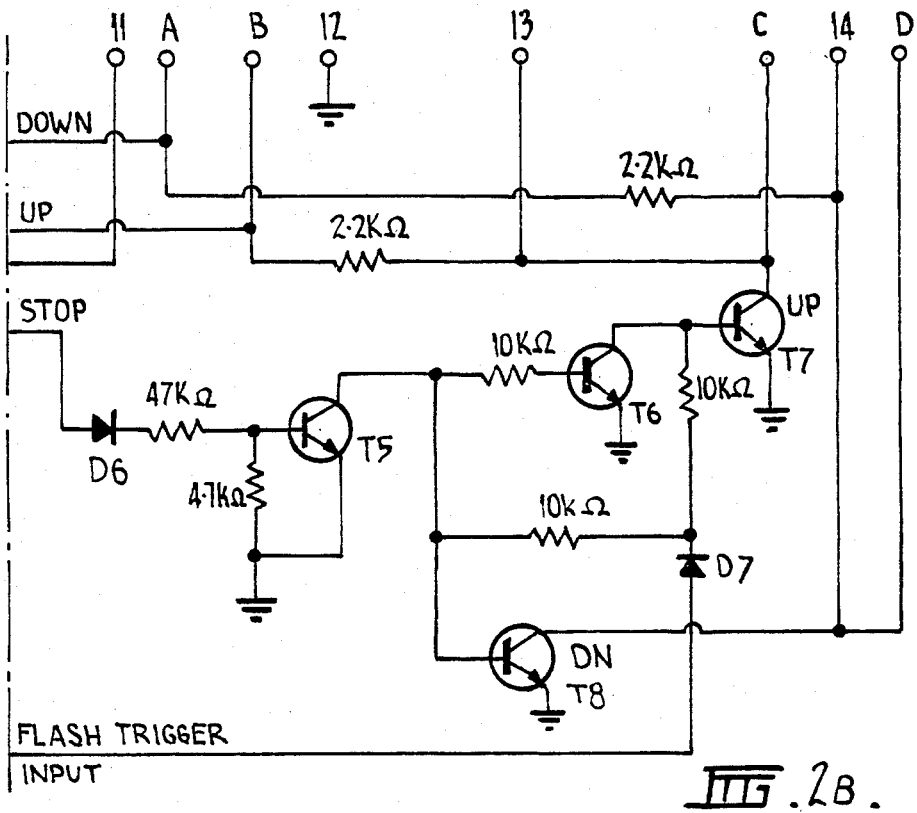
FIG. 7 is a chart showing component type numbers.
Figure 3:
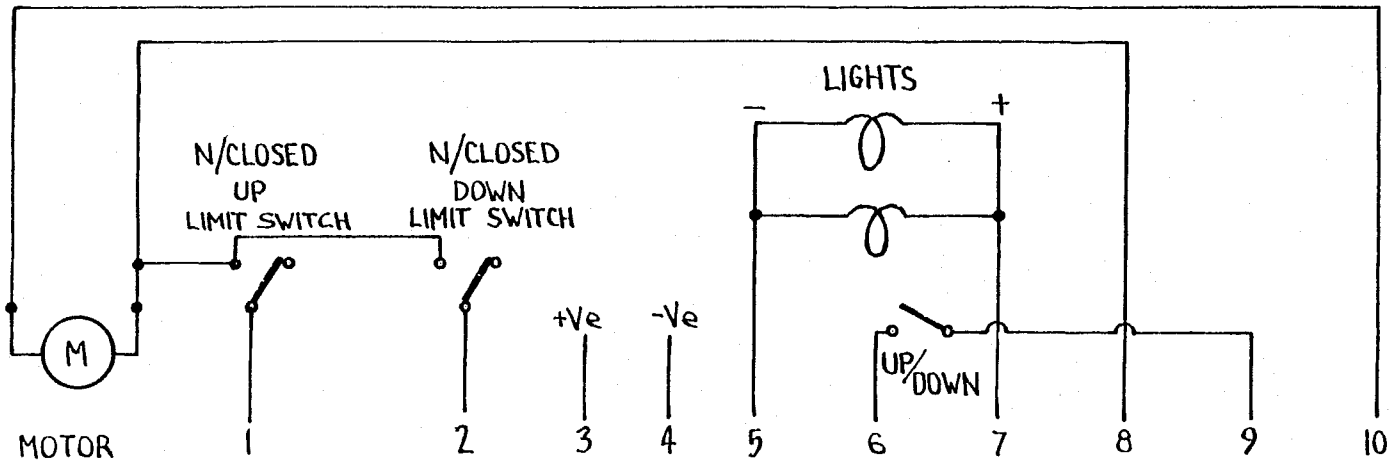
Figure 4:
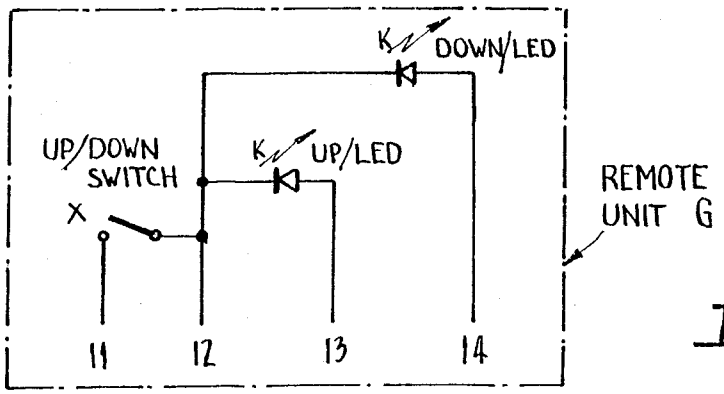

Referring now to FIGS. 2, 3 and 4 there is shown a particularly preferred embodiment for use in a domestic garage where four wires only need connect with a remote control unit which is panel G in the previous embodiment. The panel G may be placed at a convenient position within the house to which the garage belongs.

FIGS. 2A and 2B collectively show a main control unit such as would be provided on a single P.C.B. This control unit is a modification of the circuit shown in the aforementioned Australian Patent Application No. 59271/80, but it embodies the inventive concept of the latter.

FIG. 3 shows an interconnection with plug pins 1 through 10 on the P.C.B. shown in FIG. 2, and FIG. 4 shows the remote control unit G with pins 11 through 14 of the main control unit P.C.B.

Referring to the total circuit shown in FIGS. 2A, 2B, 3 and 4, the operation is as follows. When the UP/-DOWN switch X is pressed, either on a front of the remote control unit G (see switch across terminals 11 and 12 in FIG. 4) or the switch X' on the circuit shown in FIG. 3 (see the switch across pins 6 and 9) or via the radio control unit inputted into the circuit shown in FIGS. 2A, I.C.3A gate pin 8 or 9 goes low, causing a high on the output. This high causes three things to happen.

1. I.C.4 is reset via pin 11 so that R.L.L. (the switch connected with the relay for activating illuminating L.E.D.'s (see FIG. 3) in a garage to provide for security and/or safety requirements) drops out, causing the lights Z connected into that circuit to light, thereby illuminating the area within the garage. A light timer made up to I.C.3B, I.C.3C, and I.C.4 then starts timing until a basic time set by the time constant of a one microfarad condensor and a 1.2 M resistor multiplied by the counter steps of I.C.4 expires. During this time a flash time output is provided to T6, T7 and T8 for illuminating lamps L.E.D.'s in the remote control circuit G within FIG. 4. This will be described later.

2. I.C.2A provides a high to one input of both I.C.1A and I.C.1B. These inputs remain high provided that the time constant of the one microfarad condensor and the 2.2M resistor has expired.

3. I.C.2B clocks an output alternately to the second gate of I.C.1A or I.C.1B which drives the transistors T2 or T1 to close RLDN (the delay associated with the connection of power to the motor to drive the door to a down position) R.L. UP (a relay associated with switch connections for driving the motor to cause the door to move to an up position), respectively. When RLDN is operated, any overload current passing through the 0.22 ohm resistor in series to the motor causes a trip voltage (adjusted by the 50K potentiometer) to operator transistor T3. The result of this is a low at one input to the NAND gate I.C.3D the output of which gates I.C.1C, which, in turn, sets I.C.2B, causing output to I.C.1B, so that the motor will reverse and drive to the fully opened position.

At a remote location there is provided an indicating means for indicating an open and/or closed position of the garage door. This comprises 2 L.E.D.'s and 1 operating button switch UP/DOWN at the remote circuit G of FIG.4. This circuit G is connected to the main control unit by suitable hard wiring. It will be appreciated that, if desired, suitable coded information can be transmitted via radio transmitting receiving means from the remote location to the necessary input on the control unit instead of using hard wiring. This is to be considered within the scope of the invention. The contacts on RLDN provide a 24 volt output to drive the L.E.D. indicators at the remote location. This provides an 'up' sense output when the door is moving up, or is stationary up. It also provides a 'down' sense output when the door is moving down or is stationary down. Voltage feed to the respective L.E.D.'s via 2.2 K limiting resistors (see FIG. 2) and these voltages are momentarily removed by operation of the switching circuit comprised of transistors T5, T6, T7 and T8. These transistors selectively pass the voltage to the respective L.E.D.'s to earth each time a high output is received from the flash output of I.C.4. In other words, one or the other of the L.E.D.'s will be operated depending on the direction of movement of the door. During the time that I.C.4 is operating it provides flash outputs to T5 which in turn operates the respective transistors T6, T7, or T8 to in turn momentarily short the voltage to the L.E.D.'s to earth thus, causing them to be extinguished. This in turn causes the L.E.D.'s to flash, signifying that the door is moving to the open and/or closed position. A stop sense is provided from the common of the UP limit switch which goes low when the door stops in the UP position and the UP limit switch drops out. This in turn causes transistor T5 to switch off and as a result causes T6 to switch on each time the flash output goes high. The result is that T6 stops T7 from switching on and so the UP L.E.D. then finally remains continuously illuminated. When the door moves down and then stops a stop sense is provided from the common of the DOWN limit switch which gives a high 24 volt; T5 switch is on which in turn shorts the base of T8 to the negative supply and so causes the DOWN L.E.D. to stop flashing and to glow continuously indicating that the door is in the fully closed position.

It will be appreciated that many modifications may be made to the invention as would be apparent to persons skilled in the electric circuit control art and/or door mechanical arts. In the first embodiment shown here in FIG. 1, logic in the switch 1 may be provided such that when the door reaches the fully opened position either switch A or B is opened rather than closed, and thus the UP or DOWN lamps may be connected across the switch terminals, thus being illuminated once the switches A or B are opened. In this way it is not necessary to sense a current flowing to the motor M in order to cause the UP or DOWN lamps to remain illuminated continuously.

It should also be appreciated that instead of providing a lamp means to give a visual indication, mechanical visual display means may be provided. In this case the mechanical display means may include one or more colored members which are made visable and/or non visable when the door is either fully opened and/or fully closed or moving. These may be mechanically linked with the door operator and arranged to give the display at a site remote from the door.

It should also be appreciated that an audible means can be provided to give the indication that the door is moving between the opened and closed positions. Combinations of the visual and audible means is provided either alone or in combination with a visual display indicating means, then the audible display can act as security alarm for the door. In this context when installed in a domestic garage, the audible means will act to give an indication that the door is moving from the opened and/or closed positions. Accordingly, this will give audible alarm which may be heard throughout the house and announce unwanted operation of the garage door. If desired an external burgular alarm could be connected in the circuitry so that when it is set, such as at night or when the premises are vacated, then the external burgular alarm will be triggered by operation of the door.

Figure 5:
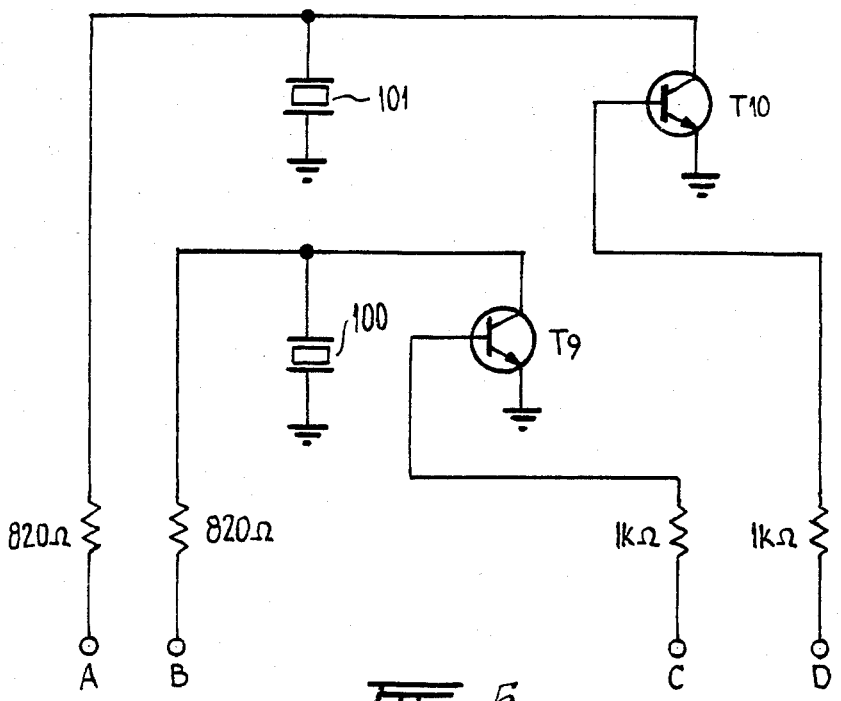
FIG. 5 shows a schematic diagram of an audible alarm indicating feature for connection with the circuit of FIGS. 2A, 2B, 3 and 4.

One example of an audible alarm indicating means is shown in FIG. 5. In this embodiment the audible alarm is used in combination with the visual lamp display means as shown in FIGS. 2A 2(B) 3 and 4.

It can be seen that FIG. 5 shows the same circuit as FIG. 2B, but it has additional transistors T9 and T10 together with two sound indicators in the form of piezo transducers 100 and 101 and transistor biasing resistors. The L.E.D. circuit operates as described previously and the audible part operates as follows.

When the door is being opened Transistor T9 starts to conduct. The flip-flop voltage on the collector of Transistor T7 is applied to the base of T9 which causes the collector of T9 to switch on and off. The Piezo Transducer 100 which is connected across the collector of T9 starts to beep on and off at the same flashing rate as the 'up' led indicator (FIG. 4). When the door is in the fully opened position, a constant voltage is applied to the base of T9, via collector of T7. This causes the T9 collector to be biased towards earth. This in turn causes the Piezo Transducer 100 to stop beeping.

The operation of the circuit in the downward motion of the door is the same as above except that T10 Transistor replaces T9 and T8 Transistor replaces T7 and Transistor T10 operates Piezo transducer 101.

Figure 6:
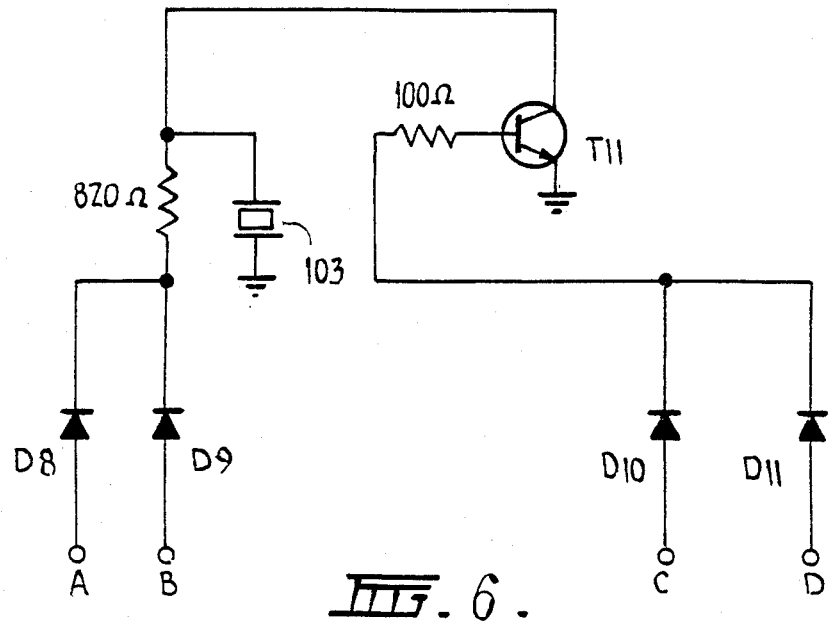
FIG. 6 is a similar circuit to that of FIG. 5 but showing a different embodiment of the audible alarm indicator.

A different circuit but functionally the same as that shown in FIG. 5 and which uses only one piezo transducer 103, is shown in FIG. 6. That circuit operates as follows.

When the door is opening a voltage is applied through diodes D1 and D2. The flip flop voltage applied at the base of Transistor T11 through D2 causes T11 to switch on and off. This causes the voltage at the collector of T11 to flip flop. The varying voltage on the collector of T11 causes the Piezo Transducer 103 to beep on and off at the same flashing rate of the ED/UP indicator (FIG. 4). When the door reaches the fully opened position, the voltage on the base of T11 becomes constant (flip flop stops), this causes the collector voltage to be biased to earth polarity. This, in turn, turns off the Piezo Transducer 103.

The operation of the circuit when the door is closing works as above except that the voltages are applied through D3 and D4.

It should be appreciated that the remote indicating means shown in FIGS. 4 and/or 5 and 6 be supplied as an optional extra for a door operator device having the operator circuit of the general type as shown in FIGS. 2(A). A switch may be connected in series with the piezo transducer(s) to switch off the audible alarm if desired.

We claim:

1. In an operator for a door, (a) drive means for moving a door to which said operator is attachable from open to closed position and from closed position to open position;

(b) initiating means for initiating said drive means to effect such movements of said door;

(c) circuit means operatively interconnected between said drive means and said initiating means to permit such movement of said door and switching off of said drive means when a fully opened or fully closed positions is reached;

(d) at least said drive means, said initiating means and said circuit means being locatable, in the vicinity of said door;

(e) second initiating means and door position indicator means locatable remote from said operator and remote from the vicinity of said door;

(f) said door position indicator means comprising an indicator for indicating the door fully closed position;

(g) said second initiating means initiating drive of said drive means to effect at least a movement of said door to fully closed position;

(h) said indicator having two operative states, including a first state in which, when it is activated, it can give a fail safe indication, and a second state in which, when it is not activated, it cannot give such indication;

(i) said door position indicator means comprising door movement indication means provided to give an indication that said door is moving between either position

2. The combination claimed in claim 1, wherein said door position indicating means comprises an indicator for indicating the door fully open position.

3. The combination claimed in claim 2, wherein said indicator which indicates that said door is fully open also has two operative states, including a first state in which it is activated and gives an indication and a second state in which it is not activated and does not given an indication.

4. The combination claimed in claim 3, wherein said indicator means which indicates that said door is fully closed is caused to cycle between its two states when said door is moving to closed position.

5. The combination claimed in claim 3, wherein said indicator means which indicates that said door is open is caused to cycle between its two states when said door is moving to open position.

6. The combination claimed in claim 1, wherein said door position indicator means is connected with said circuit means to provide an indication that said door has reached said fully closed positions in response to said circuit means operating to switch off said drive means.

7. The combination claimed in claim 1, wherein said door movement indicator means comprises said door position indicator means.

8. The combination claimed in claim 7, wherein when said door position indicator means is giving an indication that said door is moving, cyclic means connected in said circuit means is caused to cycle to, in turn, cause said indicator means to cycle between its two states.

9. The combination claimed in claim 1, wherein said indicator means comprises lamp means.

10. The combination claimed in claim 1, wherein said door movement indicator means includes an audible indicator means to also give an audible indication when said door is moving.

11. The combination claimed in claim 1, wherein said second intitiating means also permits movement of said door to fully open position.

12. The combination claimed in claim 11, wherein said circuit means includes switch means for supplying power to said drive means, logic circuit means for controlling connections to said drive means by said switch means, whereby to control the direction of movement of said drive means, said logic circuit means being connected to receive control signals from both a down circuit and an up circuit, said down circuit and said up circuit each having further switch means for indicating respectively an opening or a closing drive of said drive means.

13. The combination claimed in claim 1, wherein said further initiating means and door position indicating means are mounted together.

14. The combination claimed in claim 1, wherein said drive means is an electric motor and said circuit means includes current sensing means for sensing the current drawn by said electric motor and reversing means connected with said current sensing means to reverse the direction of rotation of said electric motor if the current drawn exceeds a normal operating current, whereby during closing of said door, the door can be automatically opened if it strikes an object under the door.

* * * * *